US005090899A

United States Patent [19]

Kee

[11] Patent Number: 5,090,899

[45] Date of Patent: Feb. 25, 1992

[54] ALL-PRIMARY TYPE GAS BURNER

[75] Inventor: Heui-Tae Kee, Seoul, Rep. of Korea

[73] Assignee: Samsung Electronics Co., Ltd., Kyungki, Rep. of Korea

[21] Appl. No.: 434,786

[22] Filed: Nov. 13, 1989

[30] Foreign Application Priority Data

Nov. 11, 1988 [KR] Rep. of Korea ..... 88-18435

[51] Int. Cl.[5] ..... F23D 14/20

[52] U.S. Cl. ..... 431/326; 431/354; 126/92 AC

[58] Field of Search ..... 431/7, 326, 328, 329, 431/354; 126/91 R, 92 R, 94 AC, 92 B, 92 C; 239/553, , 553.3, 553.5, 590, 590.3, 590.5

[56] References Cited

U.S. PATENT DOCUMENTS

| | | | |
|---|---|---|---|
| 408,235 | 8/1889 | Haskell | 239/553.5 X |
| 1,977,947 | 10/1934 | Lutenbacher | 239/553.5 X |
| 3,156,292 | 11/1964 | Ross | 239/553.3 X |
| 3,237,679 | 3/1966 | Best | 126/92 R X |
| 3,324,924 | 6/1967 | Hailstone et al. | 431/328 |
| 3,353,583 | 11/1967 | Silhavy et al. | 431/329 |

FOREIGN PATENT DOCUMENTS

| | | | |
|---|---|---|---|
| 1577719 | 10/1969 | France | 431/329 |
| 741660 | 12/1955 | United Kingdom | 431/328 |

*Primary Examiner*—Carl D. Price

*Attorney, Agent, or Firm*—Sterne, Kessler, Goldstein & Fox

[57] ABSTRACT

An all-primary type gas burner which achieves exceptional heating capacity with a small combustion surface. The burner comprises a ceramic radiation plate, mixed gas distributors, a burner main body, upper and lower laterally extending supporting base plates, gas mixing tubes, Venturi-tubes, an air control plate, air control disks, and nozzles. The ceramic radiation plate broadly disperses combustion heat in all directions. It comprises a large number of ceramic rectangular tubes of varying lengths arranged so as to form a semi-cylinder projecting from the burner main body. At the tip of each tube is a gas blowing hole. The diameter at the bottom of the semi-cylinder is greater than that at the top. The mixed gas distributors uniformly distribute mixed gas so that it blows out all of the gas blowing holes with approximately uniform gas pressure. The mixed gas distributors each have a large number of gas distributing holes.

1 Claim, 2 Drawing Sheets

ALL-PRIMARY TYPE GAS BURNER

BACKGROUND OF THE INVENTION

1. Field of the Invention

The present invention relates to a gas burner used for the room heating apparatus or cooking range and the like, and more particularly, to an all-primary type gas burner in which the burning of gas is obtainable only by the primary air sucked in together with gas for the burning by the air suction means.

2. Related Art

Heretofore, inasmuch as the all-primary type gas burner provided in gas appliances is employed with the ceramic plate of planar pattern for a radiation plate, and formed so as to be blown with gas by one nozzle and thereby the radiation heat emitted from the planar pattern type ceramic plate emits only directly forward of the ceramic plate, there has been a problem that the radiation efficiency is reduced and the portion other than front surface is extremely bad in room heating efficiency upon heating the room, and since it is burned by the gas blown with one nozzle, and capacity was small and a large number of planar pattern type ceramic radiation plate should be assembled in order for producing the high thermal capacity, there has been also a problem that the burning condition at the surface of the planar pattern type ceramic radiation plate becomes unstable.

SUMMARY OF THE INVENTION

Therefore, the present invention is contrived to solve the disadvantages of conventional appliances ad aforementioned, and it is an object of the present invention to provide an all-primary type gas burner formed with a ceramic radiation plate being produced with the surface burning at the entire surface of a burner main body having the trapexoidal pattern being wider in a bottom portion to a bent type trapezoidal pattern, and mounting the mixed gas distributor for distributing the mixed gas jetting from the gas mixing tube with the uniform pressure to thereby improve the radiation capability and the combustion efficiency.

The forgoing and other objects as well as advantages of the present invention will become clear by the following description of the invention with reference to the accompanying drawings.

BRIEF DESCRIPTION OF THE DRAWINGS

For a better understanding of the invention, and to show how the same may be carried out, reference will now be made, by way of example, to the accompanying drawings, in which.

Throughout the drawing, like reference numerals and symbols are used for designating like or equivalent parts or portions, for simplicity of illustration and explanation.

DETAILED DESCRIPTION OF THE PREFERRED EMBODIMENT

Figure 1:
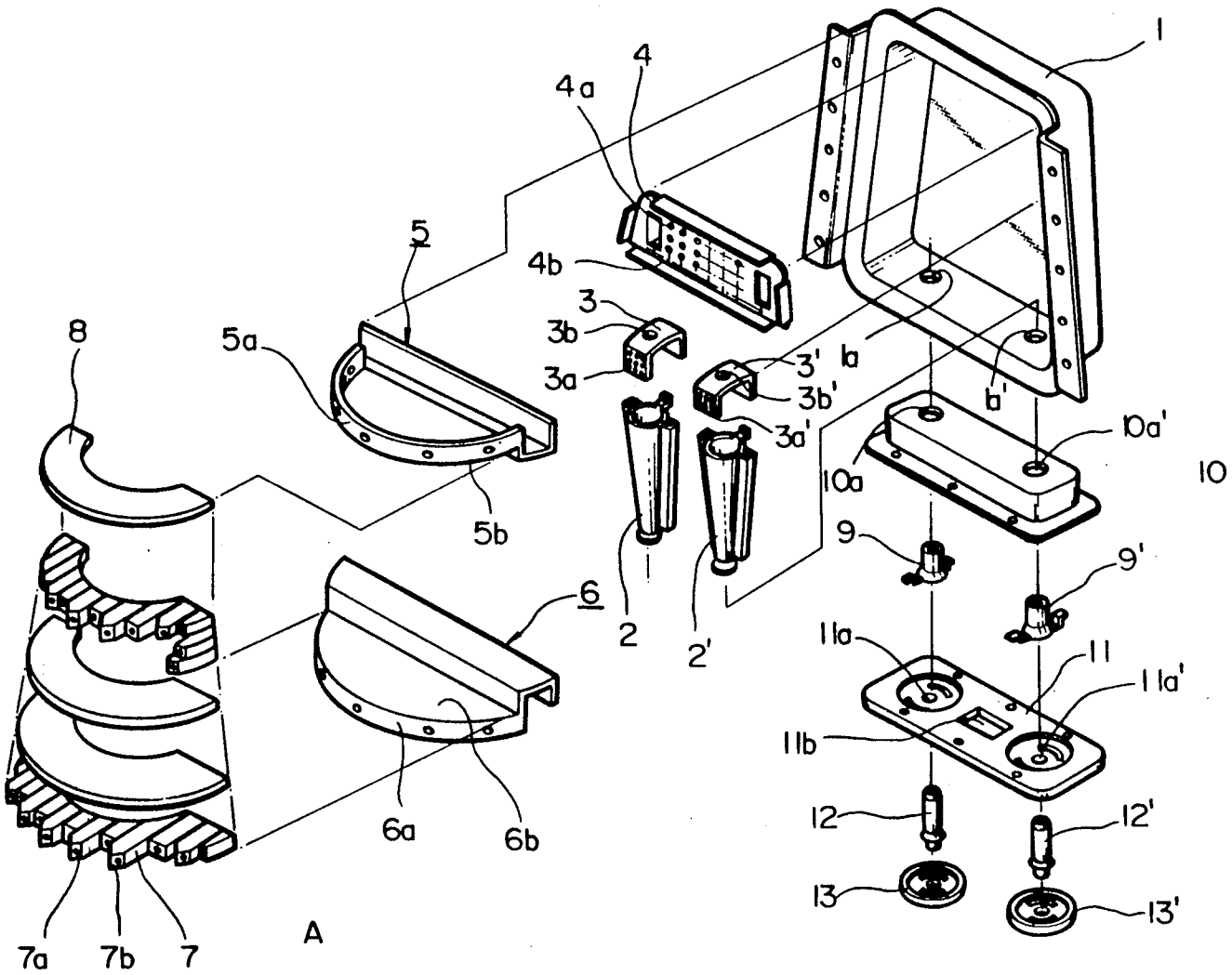
FIG. 1 is an exploded perspective view of a preferred embodiment of the present invention.

A preferred embodiment of the present invention as anforementioned with reference to the accompanying drawings is explained as followings.

In an all-primary type gas burner apparatus mounted within the room heating appliance, the apparatus of the invention is constructed such that: an air control plate case 10 is mounted to the exterior side of the bottom end portion of the burner main body 1; gas mixing tubes 2,2' diverging gradually toward the interior are fixed to the pierced holes 1*a*, 1*a'* of the burner main body respectively; "∩"-shaped primary gas distributors 3,3' are fixed on the approximately central portion of the internal side wall surface, which is are perforated with a large number of frontward gas distributing holes 3*a*, 3*a'* on the front surface thereof and the top side gas distributing openings 3*b*, 3*b'* are perforated on the top surface thereof; a secondary gas distributor 4 is fixed to the internal surface of the ceiling plate of the gas burner main body 1, which is formed with a large number of gas distributing holes 4*a* perforated on the plate thereof and the guide piece plates 4*b* standing erect around the peripery thereof; a pair of upper and lower supporting base plates 5,6 are respectively fixed to the upper and lower edge portion of the gas burner main body 1 and are formed respectively with the bent surface portions 5*a*, 6*a* and the laterally extending support plate portions 5*b*, 6*b*; and a bent type ceramic radiation plate like structural body A is fixed between the laterally extending support plate portions 5*b*, 6*b* of the upper and lower supporting base plates 5,6 by insulation materials 8, which are formed with a large number of rectangular ceramic tubes 7 differing from one another in length and having gas blowing holes 7*a* at the tip end surface of the projected portion 7*b* of the semi-cylindrical form of every tube and which are successively assembled, and as in usual gas burners, Venturi-tubes 9,9' are mounted respectively to the inserting holes 10*a*, 10*a'* within the air control plate case 10, and the air control plate main body 11 having the air suction intets 11*a*, 11*a'*, nozzles 12, 12', and air control disks 13, 13' are sequentially assembled fixed to the air control plate case 10.

The operation and effect of the preferred embodiment of the present invention constructed as aforementioned will be described in detail hereinafter.

Figure 2:
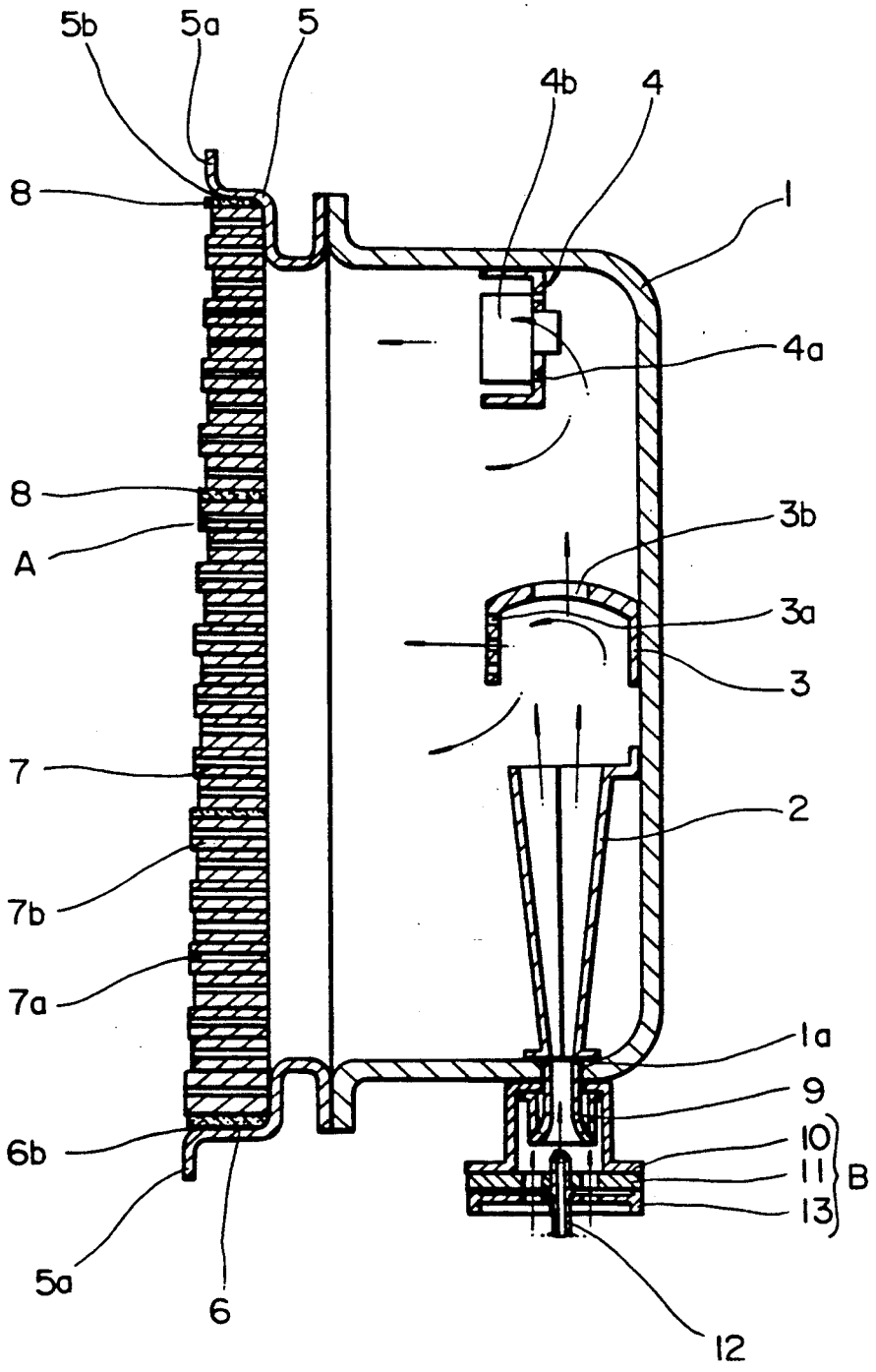
FIG. 2 is a cross sectional view taken from the sideward direction showing an assembled state of a preferred embodiment of the present invention.

As shown in FIG. 2, when a certain gas for combustion jetting from said nozzles 12, 12' is passed through the Venturi-tubes 9, 9' respectively, the low pressure regions lower than the outside ambient atmospheric pressure are formed respectively, and thereby primary air is sucked in from the outside environment through the air control disks 13, 13' and air suction inlets 11*a*, 111', 11*b*formed at the air control plate main body 11.

Thus, the sucked in gas and air for combustion becomes the mixed gas within the gas mixing tubes 2, 2' and being passed through thereof, the passed mixed gas is distributed partly to the lower end portion of the bent type ceramic radiation plate like structural body A through the frontward gas distributing holes 3*a*, the remaining part of mixed gas reaches the internal surface of the ceiling plate of the gas burner main body 1 through the top side gas distributing openings 3*b*, 3*b'*, this mixed gas is distributed to the upper end portion of the bent type ceramic radiation plate like structural body A through the gas distributing holes 4*a* of the secondary gas distributor 4, and thereby the mixed gas is distributed within the interior with uniform gas pressure, the distributed uniform pressure mixed gas is blown out of the gas blowing holes *7a* of the bent type ceramic radiation plate like structural body a, emitted to the ambient atmosphere, and ignited by usual igniting means (not shown) and thereby becoming burned on the surface of cermaics according to this, the semicylindrically formed projected portion *7b* of the rectangular ceramic tubes 7 is heated to red hot so that the radiation heat is radiated to all directions within the room.

According to the present invention as aforementioned, since the ceramic radiation plate like structural body is of a bent type, the emitting direction of the radiation heat is broadly dispersed and thereby the room heating efficiency is increased, and since numerous nozzles 12, 12' as well as many other involving parts are possible to be set within the interior of the gas burner, the suction rate of the primary air and the combustion efficiency are greatly improved, according to this, the heating capacity per unit volume can be increased, and therefore, the product can be made compactly with high combustion efficiency.

It will be appreciated that the present invention is not restricted to the particular embodiment that has been described hereinbefore, and that variations and modifications may be made without departing from the spirit and scope of the invention as defined in the appended claims and equivalents thereof.

What is claimed is:

1. An all-primary type gas burner comprising:

(a) a burner main body;

(b) air suction means which suck air and gas into said burner main body, each said air suction means comprising:

(i) an air control plate mounted on said burner main body;

(ii) a nozzle mounted on said air control plate which receives gas from outside said burner main body;

(iii) an air control disk mounted on said air control plate so as to create an opening of variable size through which air can flow into said burner main body; and (iv) a venturi which is coupled to said nozzle and said air control disk and which causes a reduction in pressure so as to suck gas from said nozzle and to suck air through said opening;

(c) gas mixing tubes located inside said burner main body, each of which receives gas and air from one of said air suction means and mixes gas and air; and (d) a plurality of gas distribution means located inside said burner main body so as to uniformly distribute gas and air flowing from said gas mixing tubes throughout said burner main body;

(e) a burner surface mounted on said burner main body comprising:

(i) a first semi-cylindrical element comprising a plurality of rectangular ceramic tubes through which gas and air flow out of said burner main body;

(ii) a second semi-cylindrical element comprising a plurality of rectangular ceramic tubes through which gas and air flow out of said burner main body, said second semi-cylindrical element having a greater diameter than said first semi-cylindrical element; and (iii) insulation material placed between said first and second semi-cylindrical elements;

(f) a first base plate which couples a first end of said burner main body to a first end of said burner surface; and (g) a second base plate which couples a second end of said burner main body to a second end of said burner surface.

* * * * *